US009265295B2

(12) United States Patent
Boulan

(10) Patent No.: US 9,265,295 B2
(45) **Date of Patent: *Feb. 23, 2016**

(54) HELMET MOUNTED LIGHTING APPARATUS AND METHOD OF MANUFACTURE

(71) Applicant: Christian Boulan, Carlsbad, CA (US)

(72) Inventor: Christian Boulan, Carlsbad, CA (US)

(73) Assignee: Highland Innovates, Inc., Carlsbad, CA (US)

( * ) Notice: Subject to any disclaimer, the term of this patent is extended or adjusted under 35 U.S.C. 154(b) by 267 days.

This patent is subject to a terminal disclaimer.

(21) Appl. No.: 13/968,426

(22) Filed: Aug. 15, 2013

(65) Prior Publication Data

US 2013/0329403 A1 Dec. 12, 2013

Related U.S. Application Data

(63) Continuation-in-part of application No. 13/462,769, filed on May 2, 2012, now Pat. No. 8,517,556, which is a continuation of application No. 12/104,388, filed on Apr. 16, 2008, now Pat. No. 8,177,384.

(60) Provisional application No. 60/912,390, filed on Apr. 17, 2007.

(51) Int. Cl.
*A42B 3/04* (2006.01)

(52) U.S. Cl.
CPC ..... *A42B 3/044* (2013.01); *Y10S 362/80* (2013.01); *Y10T 29/49117* (2015.01)

(58) Field of Classification Search
CPC ..... Y10S 2/906; Y10S 2/905; Y10S 2/98; A42B 3/0433; A42B 3/044
USPC ..... 362/105, 106, 570, 572; 2/5, 422
See application file for complete search history.

(56) References Cited

U.S. PATENT DOCUMENTS

| | | | | |
|---|---|---|---|---|
| 5,357,409 | A | 10/1994 | Giatt | |
| 5,408,393 | A | 4/1995 | Becker | |
| 5,479,325 | A * | 12/1995 | Chien | 362/105 |
| 5,544,027 | A | 8/1996 | Orsano | |
| 5,564,128 | A | 10/1996 | Richardson | |

(Continued)

OTHER PUBLICATIONS

Spartan Shield Light product description, Shining Bright on Safety. 2 pages.

(Continued)

*Primary Examiner* — Ismael Negron

*Assistant Examiner* — Leah S Macchiarolo

(74) *Attorney, Agent, or Firm* — Arc IP Law, PC; Joseph J. Mayo

(57) ABSTRACT

A helmet mounted lighting apparatus including an identification or decorative shield that may be removably coupled with the helmet. The apparatus may include one or more of at least one light, at least one power source, a microcontroller, a switch and a heat dissipater. In at least one embodiment, the at least one power source does not protrude in front of a main surface area of the identification or decorative shield. The at least one light may be focused to point forward from the identification or decorative shield, such that the at least one light illuminates an area forward of the helmet focusing on a working area of a user. The at least one light may also point downward at an adjustable angle. The apparatus may include at least one location proximal to the identification or decorative shield to place the at least one light respectively.

20 Claims, 14 Drawing Sheets

(56) References Cited

U.S. PATENT DOCUMENTS

| | | | | |
|---|---|---|---|---|
| 5,570,946 | A | 11/1996 | Chien | |
| 5,845,987 | A | 12/1998 | Painter | |
| 6,116,745 | A | 9/2000 | Yei | |
| 6,955,444 | B2 | 10/2005 | Gupta | |
| 7,210,810 | B1 | 5/2007 | Iversen et al. | |
| 7,234,831 | B1 | 6/2007 | Hanley | |
| 7,242,383 | B2 | 7/2007 | Zavracky et al. | |
| 7,784,960 | B2 | 8/2010 | Lahtinen | |
| 7,843,326 | B2 * | 11/2010 | Weber et al. | 340/531 |
| 7,845,816 | B2 | 12/2010 | Lombard et al. | |
| 2006/0133069 | A1 | 6/2006 | Clupper et al. | |
| 2007/0127232 | A1 * | 6/2007 | Maier, Sr. | 362/103 |
| 2007/0217184 | A1 | 9/2007 | Berry | |
| 2008/0080170 | A1 | 4/2008 | Lombard | |
| 2010/0300436 | A1 * | 12/2010 | McKeown | 128/202.13 |

OTHER PUBLICATIONS

TrakLite Fire Helmet Lighting System Use and Operation, Bullard, 2 pages, Jan. 22, 2013.

TrakLite Integrated Fire Helmet Lighting System, Feature Sheet, 1 page, Apr. 11, 2013.

* cited by examiner

HELMET MOUNTED LIGHTING APPARATUS AND METHOD OF MANUFACTURE

This application is a continuation in part of U.S. Utility patent Ser. No. 13/462,769, filed 2 May 2012, which is a continuation of U.S. Utility patent Ser. No. 12/104,388, filed 16 Apr. 2008, now U.S. Pat. No. 8,177,384, which claims the benefit of U.S. Provisional Patent Application Ser. No. 60/912,390 filed 17 Apr. 2007, the specifications of which are hereby incorporated herein by reference.

BACKGROUND OF THE INVENTION

1. Field of the Invention

Embodiments of the invention described herein pertain to the field of lighting. More particularly, but not by way of limitation, one or more embodiments of the invention enable a helmet mounted lighting apparatus and method of manufacture.

2. Description of the Related Art

Lighting apparatus such as a flashlight or headlight with head strap provide portable lighting. These apparatus use halogen, standard filament, neon and light emitting diodes (LEDs) to emit light. Various methods of powering portable lights include cylinder, coin, button, disposable and rechargeable batteries.

Currently known portable lighting apparatus are generally bulky and difficult to control, i.e., turn on or off in certain environments or situations. For example, attempting to operate a small light switch with gloves on in an environment that requires gloves is difficult. Hand held lights require use of one hand to hold the light, which is unacceptable to users that require both hands to be free.

Mining lanterns and headlamps are bulky and/or protrude from a mining helmet for example. These types of lights provide underground portable lighting for miners. The headlamps catch on objects in the environment and are not easy to operate.

For at least the limitations described above there is a need for a helmet mounted lighting apparatus and method of manufacture.

BRIEF SUMMARY OF THE INVENTION

One or more embodiments of the invention enable a helmet mounted lighting apparatus and method of manufacture. For example, by coupling the apparatus with a helmet or fire shield, the apparatus may be worn on a fire helmet. In this embodiment, the apparatus is manufactured to conform to the helmet shape and optionally couple to the inside of the helmet or to a fire shield worn on the outside of the helmet. By coupling the apparatus to a helmet, the apparatus does not interfere with the operation of goggles for example. In addition, by utilizing a touch based switch, the apparatus may be operated, i.e., turned on or off without removing one's gloves. Use of lights such as light emitting diodes (LEDs) allows for longer use without replacing batteries. Furthermore, LED lights are shock resistant and allow for rugged deployment to a variety of environments that promote short life for filament-based lights. Time-out circuitry may be utilized to turn the light off after a specified amount of time to avoid accidental battery drain. Preventing accidental battery drain provides a more robust apparatus that remains operational longer between battery replacement.

In embodiments of the invention that utilize at least one LED, the LED is typically in the form of a LED bulb. The LED bulb uses a glass lens capsule to direct light to the rounded tip of the capsule. This bending of light causes a narrow high intensity focus at the tip and a diverging beam emanating from the tip. The LED(s) is/are adapted to emit light in at least one direction.

An activation button is utilized for activation of the LED. The button may include a push button or pressure sensor that allows for easy operation without requiring a small switch to be activated for example.

A power source is coupled with the LED(s) and is configured as a slender design for unobstructed mounting. One embodiment of the power source is a battery housing. A battery housing contains a battery or series of batteries attached at one end thereof to the lights e.g., LEDs or series of LEDs. Slender coin style batteries, like the ENERGIZER® 2016 and 2032 type batteries may be utilized in one or more embodiments to provide power to the LED(s) either through direct electrical contact or wiring. In other embodiments of the invention, AAA, AA or any other cylindrical type battery may also be utilized. Wiring may provide further latitude in customization.

Circuitry may be utilized along with the standard features of the apparatus. Since accidental activation and subsequent drain of unit power source can be problematic, the apparatus may include circuitry that powers down the light after a configurable or specified amount of time.

Features provided by the apparatus make the invention ideal for use in the fire service as service lights on fire helmet shields or similar fields. Functionality of fire shields has been limited to numbering and lettering for identification purposes and many have maintained a purely ornamental aspect to their use. The combination of the LED unit and fire shield brings a new level of functionality to the shield not previously known.

Safety helmets are increasingly used in work applications. Many applications require means of identification or desire decorative additions to the helmets. The fire service uses slender, pliable shields, typically made of leather, that serve as both decoration and identification. Fire shields are used on virtually every safety helmet in service at fire departments within the United States. The LED assembly may be used as a medallion type assembly for mounting on identification or decorative shields, as found in the fire service, or mounted directly within the shield or helmet.

Potential uses and markets are not limited to the fire service industry or markets using helmet shields. The ability of the apparatus to operate in harsh environments and the low-profile mounting enables the invention to provide usefulness in a variety of fields that require dependable lighting. Cave exploring, camping, interior lighting are additional fields where this product may be utilized for example.

Approved specialty gels, silicones and sealant strips may be utilized for sealing the housing from the harsh environment. A PCB assembly is an inexpensive means on constructing multiple units. In circumstances where exterior wiring is required, temperature resistant wiring provides further product ruggedness and robust operation in dangerous environments.

One or more embodiments of the invention may be manufactured by coupling an LED to a power source and touch switch and further coupling the apparatus to a helmet or shield configured to be mounted on a helmet.

One or more embodiments of the invention may include an identification or decorative shield that may be removably coupled with the helmet, such that the identification or decorative shield may conform to a shape of the helmet. In one or more embodiments, the apparatus may include one or more of at least one light, at least one power source, a switch and a heat dissipater coupled with the at least one light. The at least one power source may couple with the at least one light using an electrical connection does not travel through an outer wall of the helmet to an inner portion of the helmet. In at least one embodiment, the at least one power source does not protrude in front of a main surface area of the identification or decorative shield.

By way of one or more embodiments, the switch may couple with the at least one power source and at the least one light, such that the switch may activate the light when the switch is pressed or otherwise activated in any manner for example. The at least one light may be focused to point forward from the identification or decorative shield, such that the at least one light illuminates an area forward of the helmet. In at least one embodiment, the at least one light may point downward at an adjustable angle. One or more embodiments of the invention may include at least one location proximal to the identification or decorative shield to place the at least one light respectively, and at least one area on the identification or decorative shield such that the at least one area may receive identification or decorative additions.

In at least one embodiment, the switch may be remote to the at least one power source and remote to the identification or decorative shield. As such, the switch may remotely activate the light when the switch is pressed. In one or more embodiments, the switch may be coupled to a rear portion of the identification or decorative shield, or located behind the identification or decorative shield, and the switch may activate the light when a front portion of the identification or decorative shield is pressed, and that in turn presses the switch.

Embodiments of the invention may include a microcontroller coupled with the power source. In one or more embodiments, the microcontroller may cycle through a plurality of power levels to provide multiple light levels from the at least one light when the switch coupled with the identification or decorative shield is pressed. In at least one embodiment, the microcontroller may automatically adjust a power setting of the at least one light based on ambient light or after a configurable period of time, and may turn off the at least one light after a configurable timeout period.

One or more embodiments of the invention enable a method of manufacturing a helmet mounted lighting apparatus, such that the method of manufacture includes one or more of coupling the at least one light to the at least one power source, coupling the at least one light to the switch and to the at least one power source with an electrical connection that does not travel through an outer wall of the helmet to an inner portion of a helmet, and coupling the heat dissipater to the at least one light. In one or more embodiments, the at least one power source does not protrude in front of a main surface area of the identification or decorative shield. Embodiments of the method of manufacturing invention may include conforming the identification or decorative shield to a shape of the helmet, configuring the identification or decorative shield to removably couple with the helmet, and placing the at least one light proximal to the identification or decorative shield.

In at least one embodiment, the method of manufacturing may also include configuring the at least one light to focus the at least one light to point forward from the identification or decorative shield, or may be configured to point downward at an adjustable angle, such that the at least one light may illuminate an area forward of the helmet. Embodiments of the invention may include configuring the at least one area on the identification or decorative shield to receive identification or decorative additions, and configuring the switch to activate the at least one light when the switch is pressed.

Embodiment of the method of manufacturing may include remotely coupling the switch to the identification or decorative shield and the at least one power source, such that the configuring of the switch may include configuring the switch to remotely activate the at least one light when the switch is pressed. In one or more embodiments, the method of manufacture may include coupling the switch to a rear portion of the identification or decorative shield, and configuring the shield to press the switch and activate the light when a front portion of the identification or decorative shield is pressed. In at least one embodiment, the method of manufacture may include locating the switch behind the identification or decorative shield.

In one or more embodiments of the invention, the method of manufacturing the helmet mounted lighting apparatus may also include coupling the microcontroller to the at least one power source and one or more of configuring the microcontroller to cycle through a plurality of power levels to provide multiple light levels from the at least one light when the switch coupled with the identification or decorative shield is pressed, configuring the microcontroller to automatically adjust a power setting of the at least one light based on ambient light or after a configurable period of time, and configuring the microcontroller to turn off the at least one light after a configurable timeout period.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

A helmet mounted lighting apparatus and method of manufacture will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
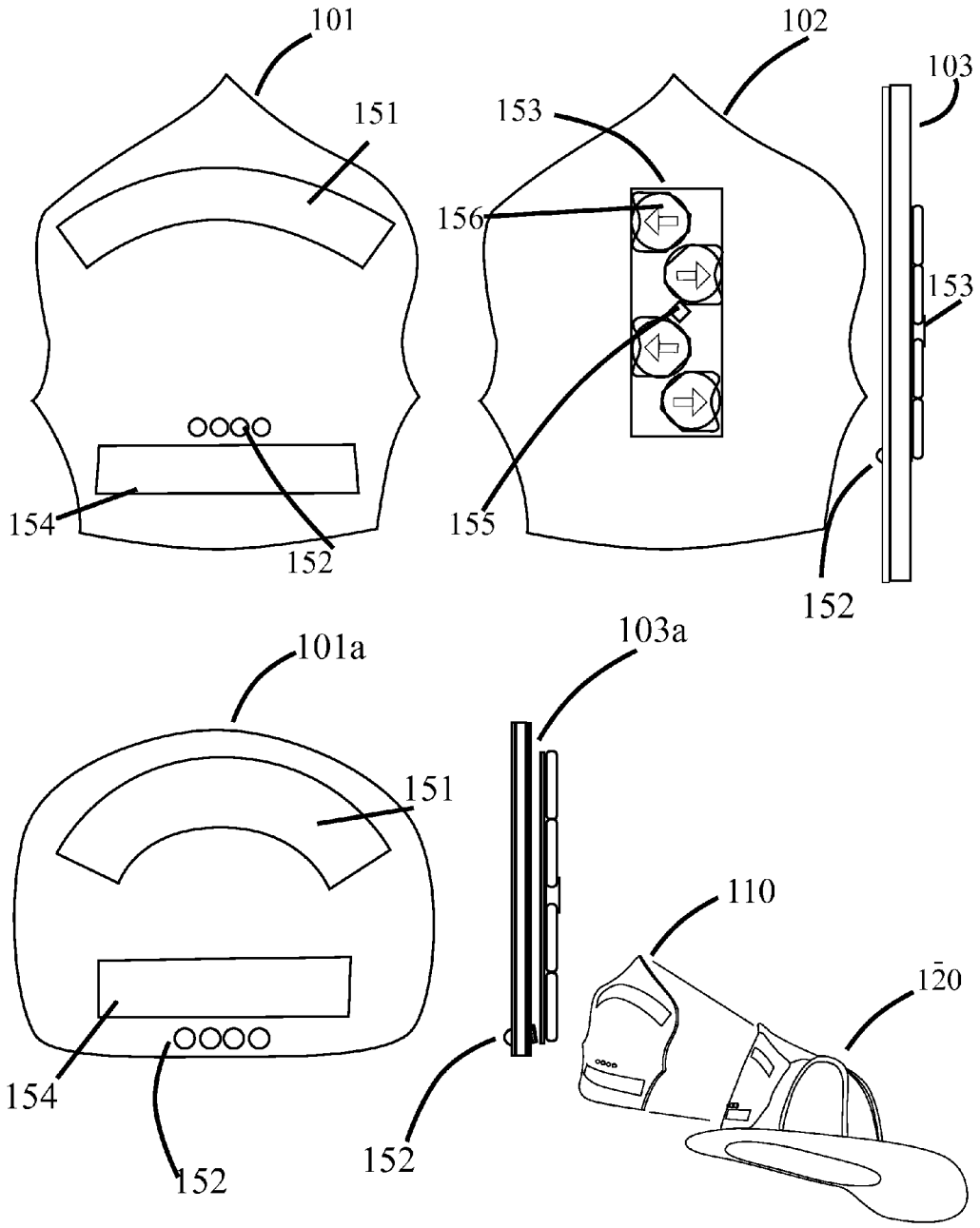
FIG. 1 shows front, back and side views of one embodiment and front and side views of a second embodiment and in addition shows helmet mounting.

FIG. 1 shows front, back and side views 101, 102 and 103 respectively of one embodiment and front and side views 101*a* and 103*a* of a second embodiment. In addition, FIG. 1 shows helmet mounting of shield 110 on helmet 120. Any type of coupling element may be utilized in mounting lighting apparatus 153 to shield 110 including but not limited to hook and loop material, sewn material, threaded screws or adhesive. Front view 101 of shield 110 shows name areas 151 and 154 for applying text for example. LEDs 152 extend from the rear of shield 110 to the front so that light may emit from shield 110. LEDs 152 are activated in this embodiment by pressing on the front of shield 110 that activates switch 155. Any type of switch may be utilized including a push-button switch (latching or non-latching) or toggle switch. A push-button switch of the non-latching type may include a latching circuit to keep the light on after the finger is taken off of the switch or button coupled with the switch. Use of a short throw switch allows for mounting the switch behind the shield. If the switch utilized has a longer throw, then a hole may be drilled into the shield that allows for the switch to be accessed. Hence, the switch may protrude through the shield or be situated behind the shield in keeping with the spirit of the invention. In other embodiments, the switch may be mounted remotely as will be described below. In one or more embodiments of the invention, lighting apparatus 153 includes a PCB board. LEDs 152 are powered by power source 153, in this case a battery although fuel cells or any other type of power source may be utilized. These are shown in back view 102. Side view 103 shows the thickness of this embodiment that allows for mounting between the shield and a helmet for example.

A second embodiment is shown coupled with the shield shown in front view 101*a*. Side view 103*a* shows a thickness that may be greater than the thickness shown in side view 103 to accommodate more power source elements in depending on the application, i.e., shield size and helmet size and/or curvature for example.

Figure 2:
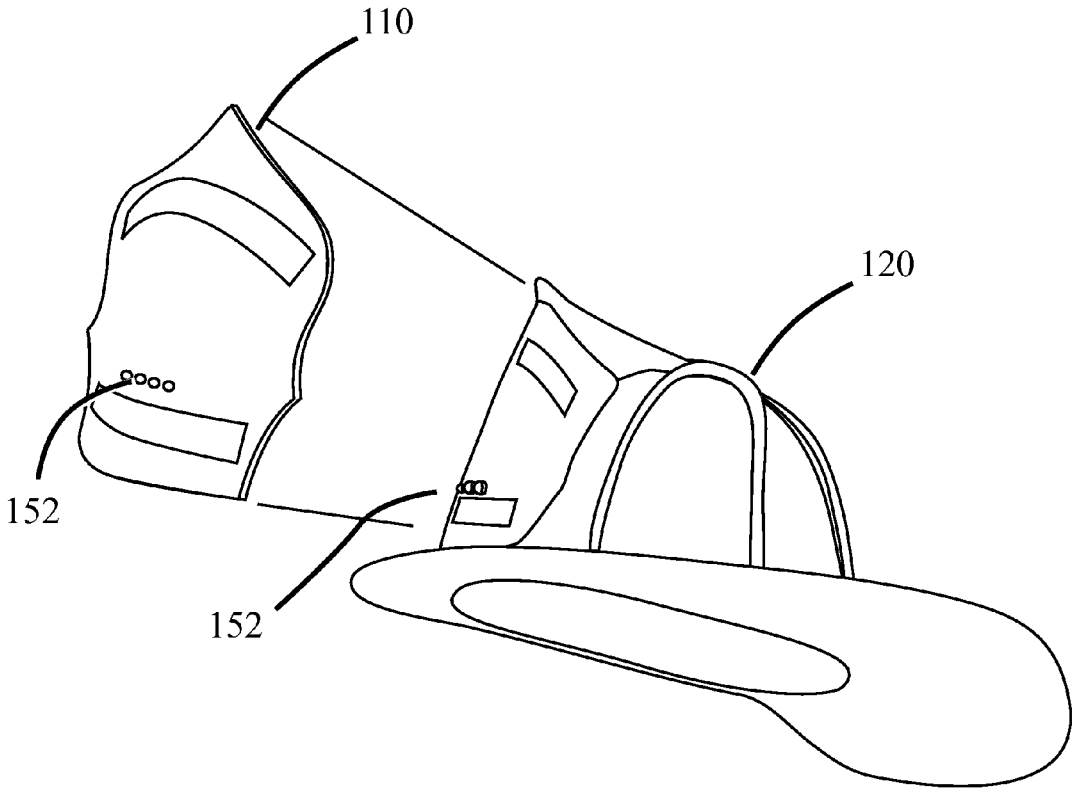
FIG. 2 shows a close up of the helmet mounting of FIG. 1.

FIG. 2 shows a close up of helmet 120 mounting with shield 110 of FIG. 1. With LEDs 152 coupled with shield 110, helmet 120 thus is coupled with LEDs 152 when shield 110 is coupled with helmet 120. In other embodiments of the invention, lighting apparatus 153 may be mounted inside helmet 120 for example with a painted shield on the front of helmet 120. Any ornamental covering placed in front of lighting apparatus 153 that is coupled with a helmet is in keeping with the spirit of the invention.

Figure 3:
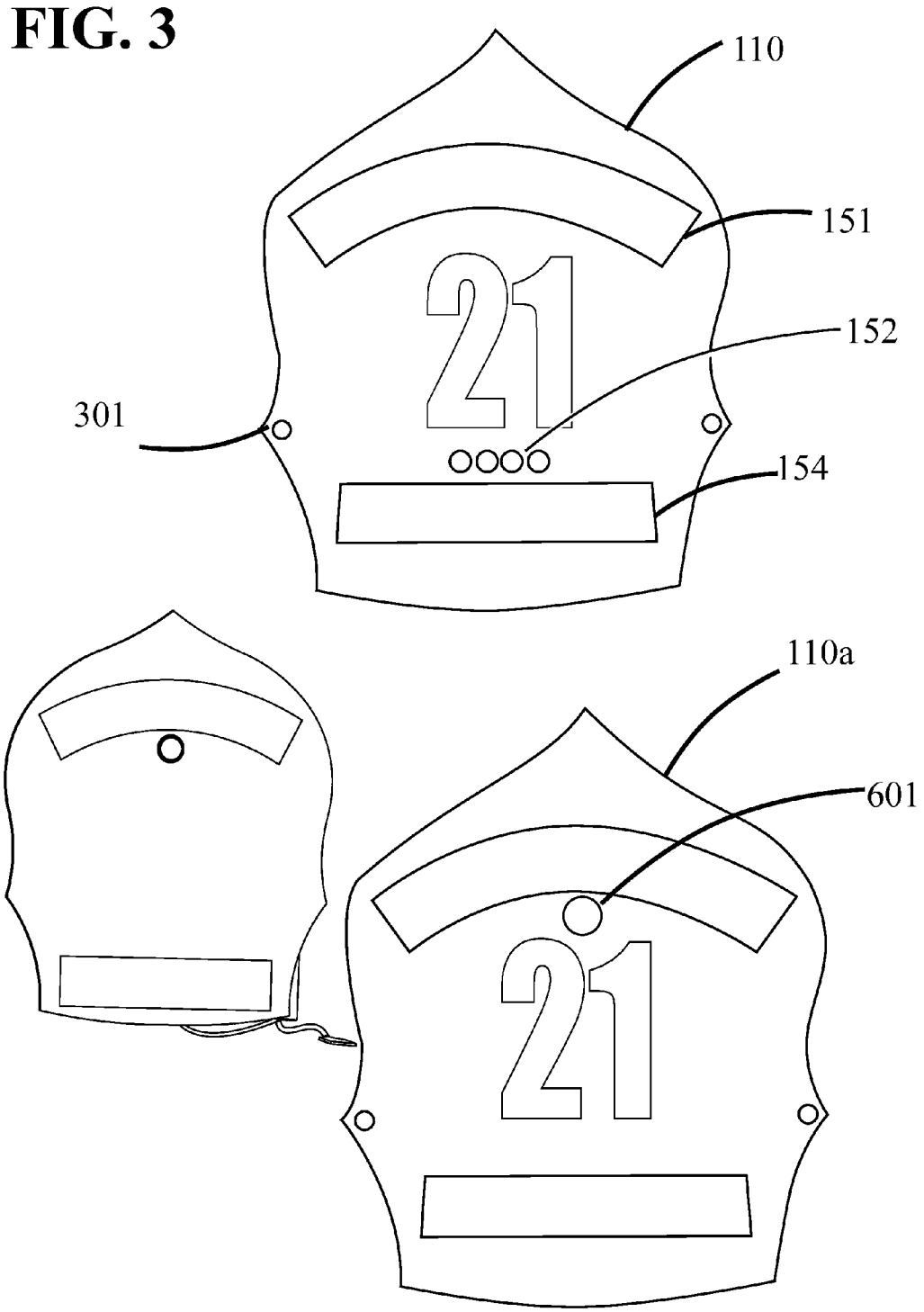
FIG. 3 shows an embodiment coupled with a shield.

FIG. 3 shows an embodiment coupled with shield 110. In this figure, LEDs 152 can be seen at the center of shield 110 that is activated by pressing the center of the shield (where the large number "21" appears). Coupling hole 301 is but one type of connection object that may be utilized in coupling shield 110 with a helmet. Types of connectors that may be utilized in coupling shield 110 to a helmet include but are not limited to hook and loop material, sewn material, threaded screws or adhesive. In addition, FIG. 3 also shows another embodiment of shield, namely shield 110*a*. In this embodiment, light 601 is mounted without use of a PCB board and hence termed the "remote" embodiment since the power source and switch may be mounted remotely with respect to light 601. Light 601 may include an LED and optic or reflector to spread the light over any desired angle.

Figure 4:
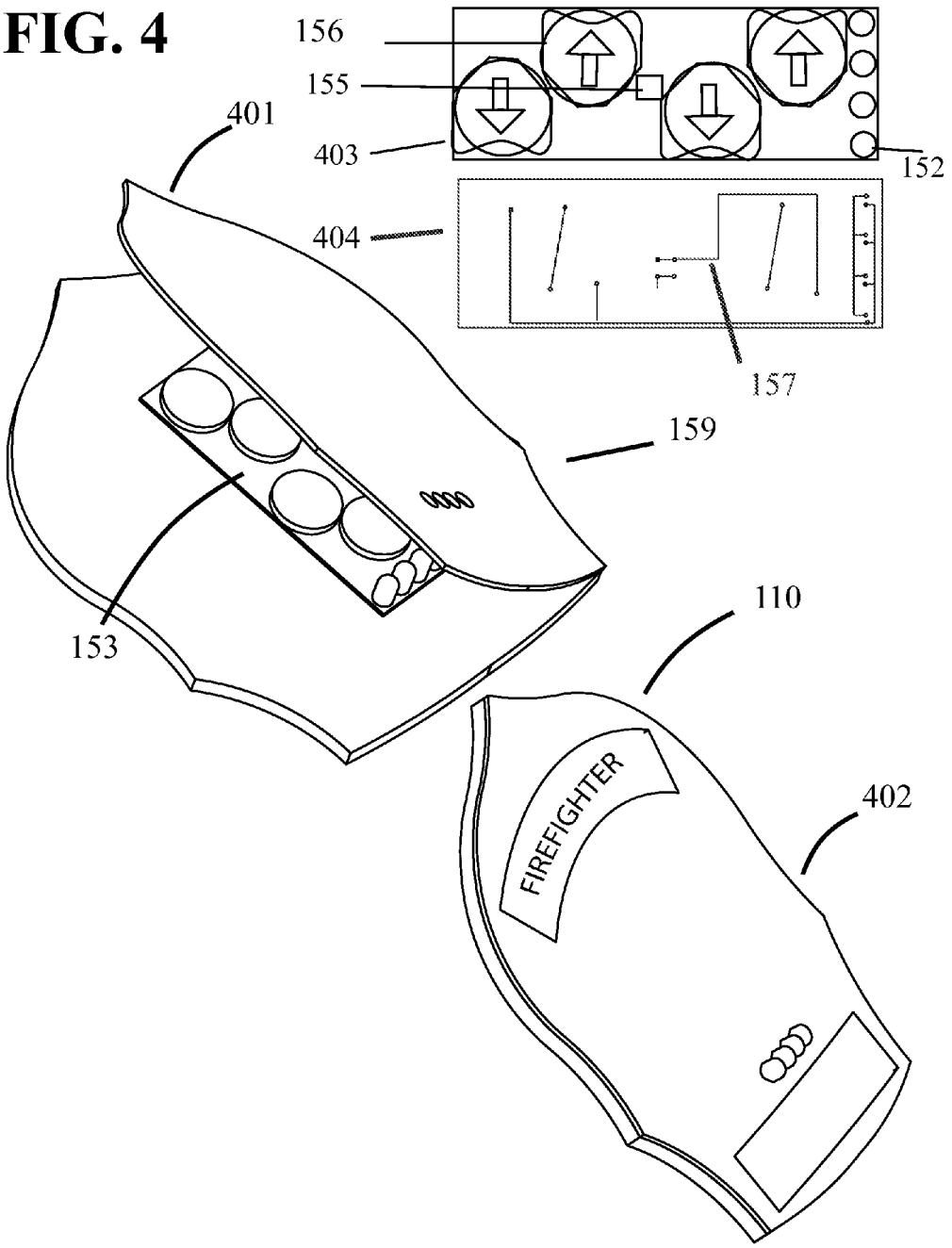
FIG. 4 shows an embodiment mounted behind a shield and a top and bottom view of a circuit configured to couple a power source to a switch to at least one light.

FIG. 4 shows an embodiment mounted behind shield 110 and top and bottom views 403 and 404 respectively of a circuit configured to couple power sources 156 to switch 155 to at least one light 152. Lighting apparatus 153 is shown on back view 401 of a shield with protective covering 159 peeled back. Front view 402 shows shield 110 in the forward orientation. Back view 403 of the apparatus shows power sources 156 and switch 155 while rear view 404 shows lines 157 connecting each power source to one another. In one or more embodiments of the invention, the batteries are connected in parallel, although the power sources may also be connected in series depending on the voltages of the LEDs in relation to the voltages of the batteries.

Figure 5:
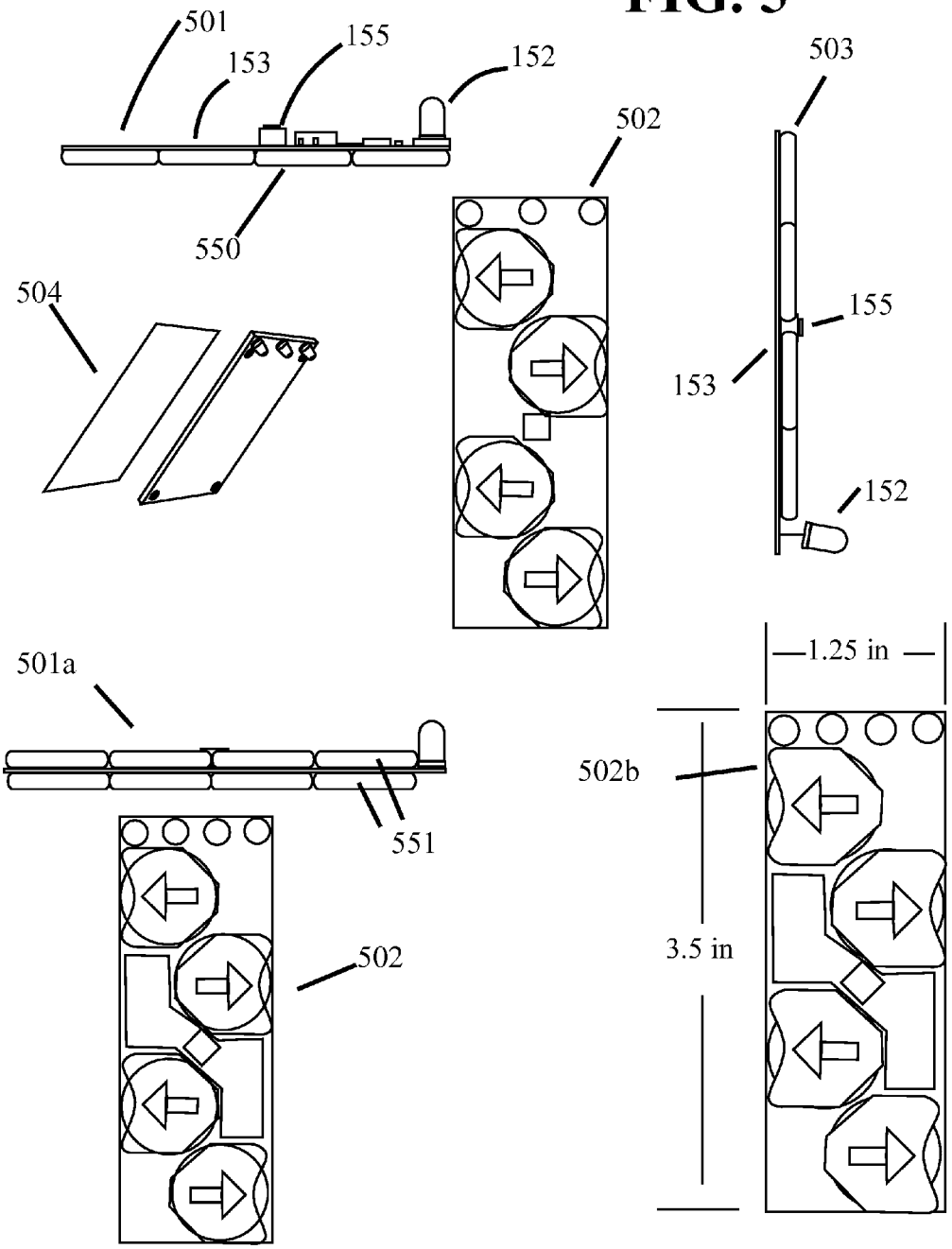
FIG. 5 shows two embodiments of the invention, one with power source elements on one side and the other with power source elements on both sides of the apparatus.

FIG. 5 shows two embodiments of the invention 501 and 501*a*, one with power source elements on one side and the other with power source elements on both sides of the apparatus. Lighting apparatus side view 501 is shown with power sources 550 only on the rear side of the apparatus while lighting apparatus side view 501*a* is shown with power sources 551 on both sides of the apparatus for increased power. Other embodiments of the invention may utilize remote battery housings that may reside away from the shield to increase the amount of battery reserve available to the lights as well be described below. Rear views 502 and 502*a* show the power sources, while front view 502*b* also shows the power sources. Side view 503 also shows an embodiment with lights 152 pointed down at 10 degrees. Any other angle of orienting lights 152 is in keeping with the spirit of the invention.

Figure 6:
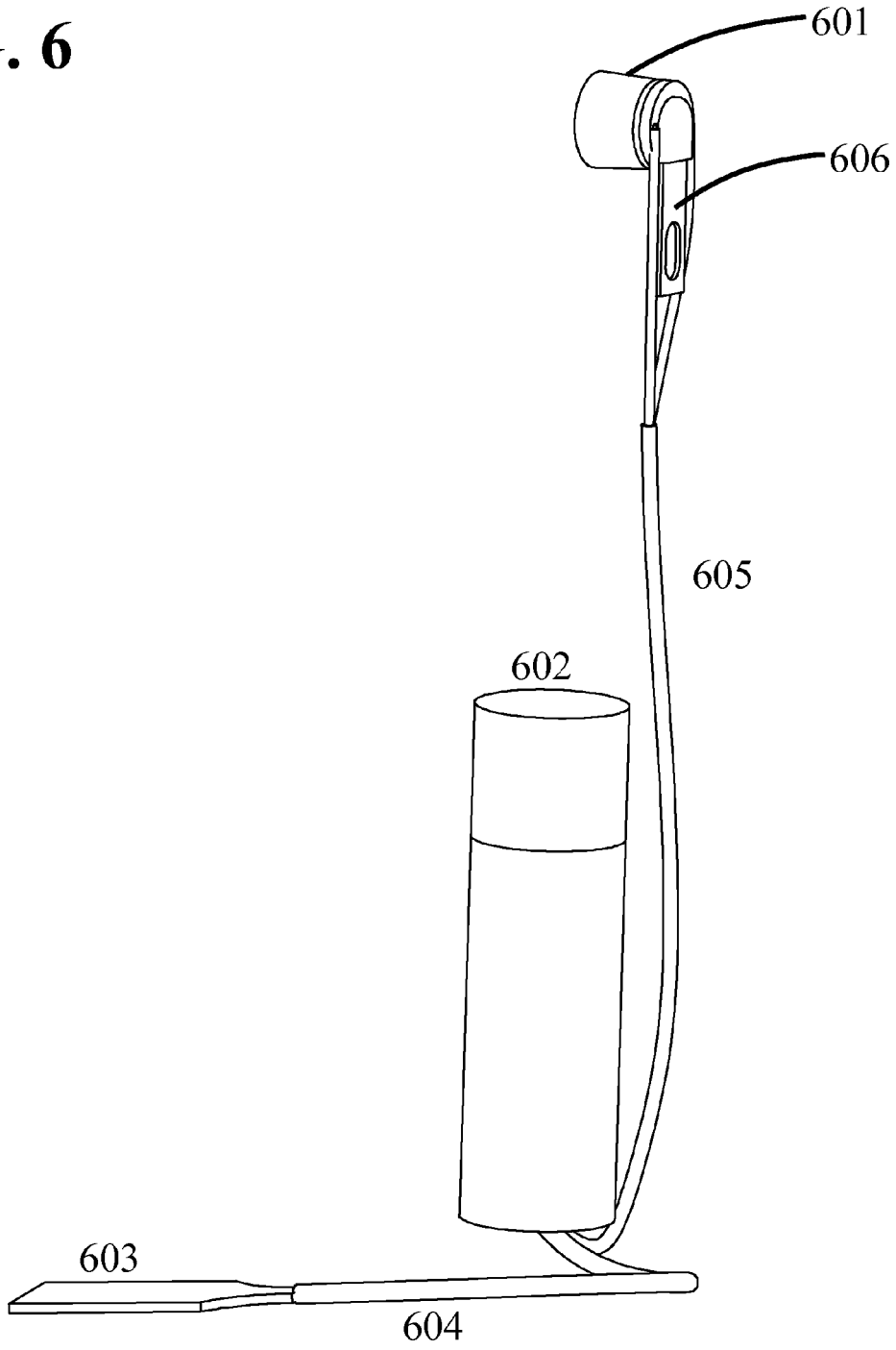
FIG. 6 shows the embodiment of the light apparatus known as the "remote" embodiment.

FIG. 6 shows the embodiment of the light apparatus known as the "remote" embodiment. In this figure, light 601 is coupled to mounting unit 606 that is coupled with shield 110*a*. Alternatively, mounting unit 606 may couple with helmet 120 in one or more embodiments. Light 601 obtains power from power source 602 via wire 605. Switch 603 couples with power source 602 via wire 604. Power source 602 may include an external housing, for example a plastic or metal housing configured to hold one or more batteries and any desired circuitry.

Figure 7:
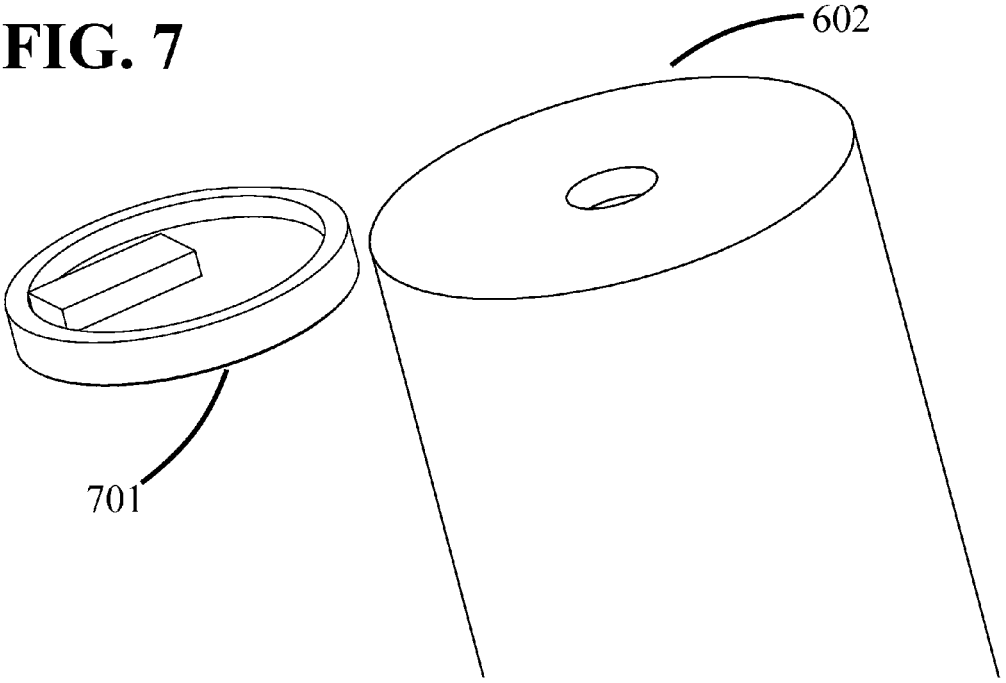
FIG. 7 shows the top of a power source and in addition shows one embodiment of circuitry that may be utilized to control the power source.

FIG. 7 shows the top of power source 602 and in addition shows one embodiment of circuitry 701 that may be utilized to control power source 602. In one or more embodiments, circuitry 701 may be located within a housing associated with power source 602. One embodiment of the invention may utilize a power boost circuit and/or regulator to maintain desired light level from light 601. An example embodiment of circuitry 701 may include a LM2623 boost circuit and PIC 10F200 microcontroller for example. The microcontroller may be programmed to cycle through multiple power levels for example or to toggle power on or off with respect to light 601 or to simply power off after any desired time period. In one or more embodiments, any type of switch coupled with the apparatus may be utilized to indicate to the microcontroller the desired power level for example by asserting the switch multiple times to cycle through the various levels. Any other method of instructing the microcontroller to change power settings is in keeping with the spirit of the invention including any wireless or wire based communication path leading to an external computing element configured to communicate with the microcontroller as one skilled in the art will recognize. The microcontroller may be coupled with a power indicator LED or may flash or otherwise alter the intensity of the emitted light from light 601 in an on-off or up/down ramped intensity pattern or any combination thereof to indicate a particular threshold or level of power.

Figure 8:
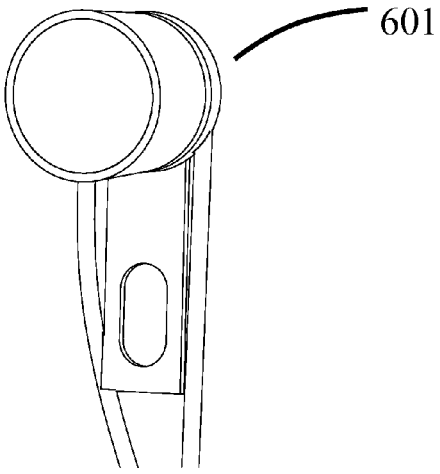
FIG. 8 shows a close up of an embodiment of the light.

FIG. 8 shows a close-up of light 601. An example embodiment of light 601 may include an LED and optional optic, reflector or collimator. Any angle of light emission desired may be selected through utilization of the desired optional optic, reflector or collimator.

Figure 9:
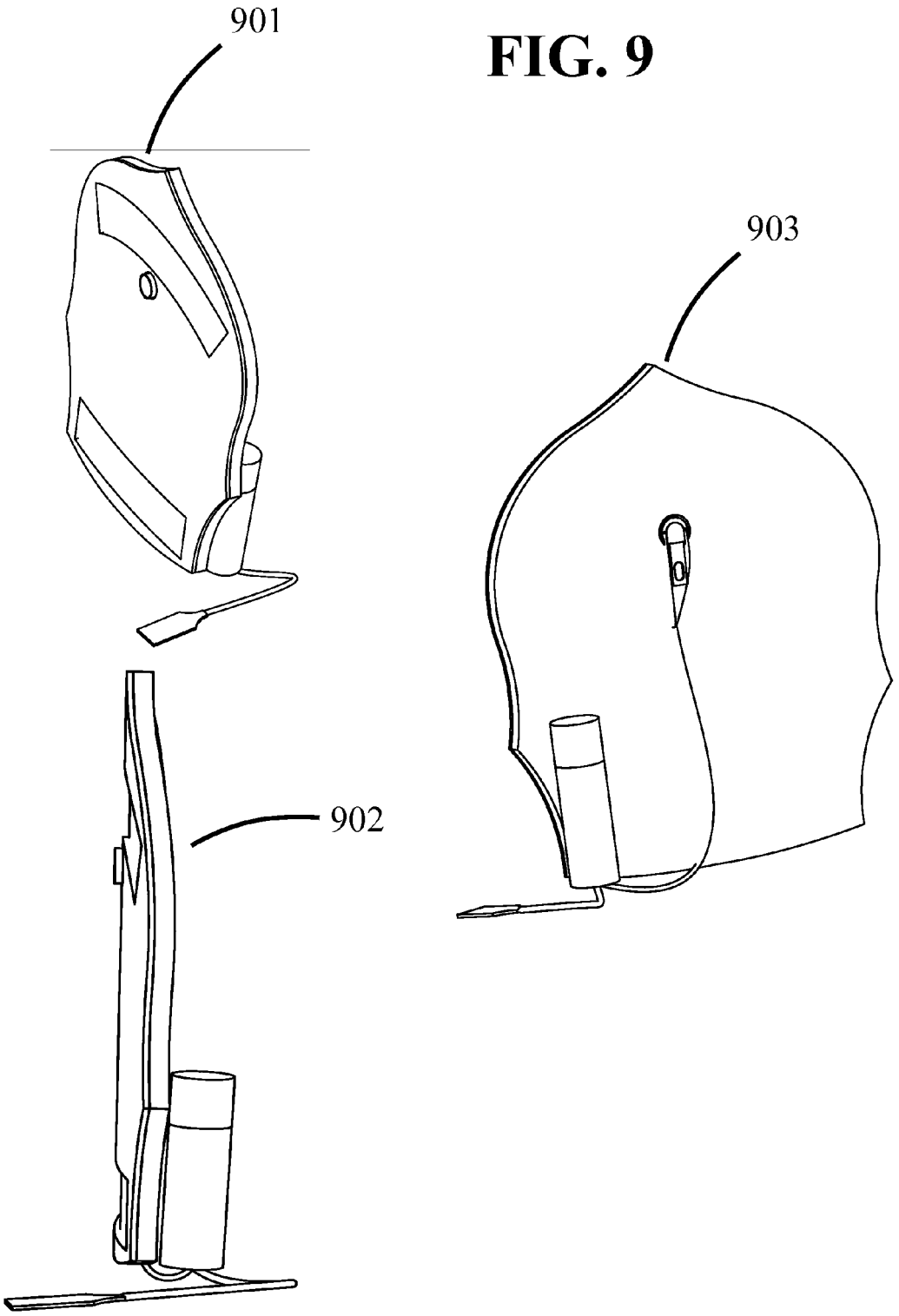
FIG. 9 shows a top perspective view, side view and rear view of the remote embodiment coupled with a shield.

FIG. 9 shows a top perspective view 901, side view 902 and rear view 903 of the remote embodiment coupled with a shield. Also, see FIG. 3 for an alternate embodiment coupled with a shield.

Figure 10:
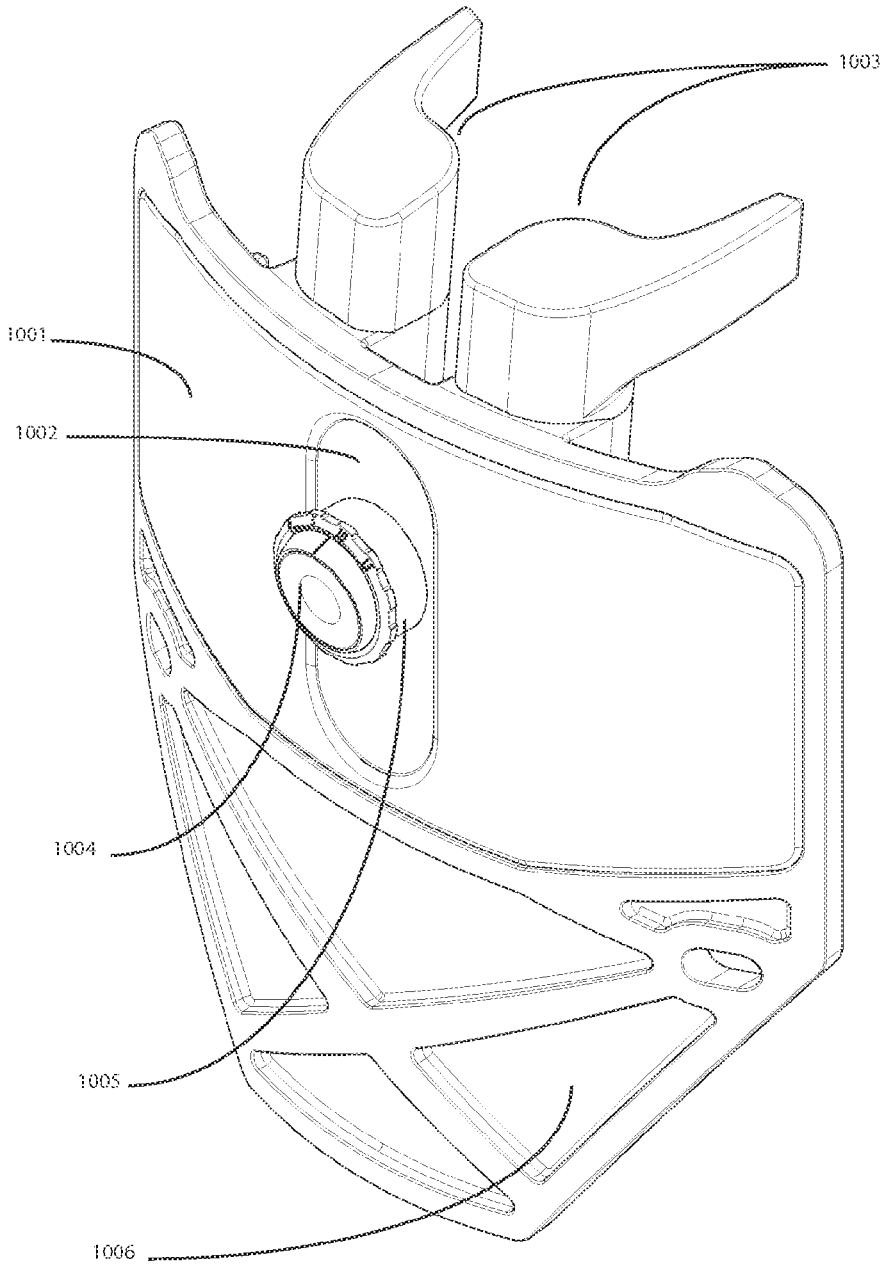
FIG. 10 shows an overall structural view of the helmet mounted lighting apparatus according to one or more embodiments.

FIG. 10 shows an overall structural view of the helmet mounted lighting apparatus according to one or more embodiments. As shown in FIG. 10, one or more embodiments of the invention may include an identification or decorative shield, such as shield 110 that may be removably coupled with the helmet 120, such that the identification or decorative shield may conform to a shape of the helmet 120. In one or more embodiments, the apparatus may include one or more of at least one light such as light 152, an LED lens 1004, an LED housing 1005, at least one power source such as at least one battery and/or power source 551 or 602 as discussed above, a dual battery housing 1003, a switch such as switch 155, 603 or button overlay 1007, and a heat dissipater 1001 coupled with the at least one light. The at least one power source may couple with the at least one light using an electrical connection that does not travel through an outer wall of the helmet 120 to an inner portion of the helmet 120. In at least one embodiment, the at least one power source does not protrude in front of a main surface area of the identification or decorative shield.

In one or more embodiments, the heat dissipater 1001, such as a heat sink, is shown as a large front flat metal section area that may be augmented by two sets of fins that extend through the back of the apparatus in order to dissipate heat generated by the LED. In at least one embodiment, the LED housing 1005 allows for an angle adjustment by a user. In at least one embodiment, the at least one light, such as the LED, may point downward at an adjustable angle. The angle adjustment allows the user to set an angle for use of the apparatus during installation and fire use. As such, the angle adjustment is critical in ensuring that the at least one light is not angled substantially upwards in order to illuminate a functional work area of the user rather than illuminating above the functional work area of the user if angled substantially upwards.

According to at least one embodiment of the invention, FIG. 10 shows area 1002 where a circuit board is placed in order to adjust and change the height of the LED lens housing 1005. The circuit board may include a microcontroller. In addition, embodiment may include a dual battery housing 1003, a mount housing 1006 and a button overlay 1007. In one or more embodiments, the dual battery housing 1003 is used to accommodate different features of helmet 120.

In at least one embodiment of the invention, the mount housing 1006 allows for components to be mounted to the identification or decorative shield, and the button overlay 1007 may include power buttons placed on one or more of a left side and a right side of the apparatus.

By way of one or more embodiments, the switch, such as switch 155, 603, 1007 or any other type of switch, may be coupled with the at least one power source, such as the at least one battery, and at the least one light, such that the switch may activate the light when the switch is pressed. The switch may be positioned anywhere on the helmet or remotely for example. The at least one light, such as the LED, LED lens and/or LED housing, may be focused to point forward from the identification or decorative shield, such that the at least one light illuminates an area forward of the helmet, illuminating the functional work area of the user. One or more embodiments of the invention may include at least one location proximal to the identification or decorative shield to place the at least one light respectively, for example on one or more of the sides of the shield or close to but not touching the shield, e.g., on the helmet, and at least one area on the identification or decorative shield such that the at least one area may receive identification or decorative additions.

In at least one embodiment, the switch may be remote to the at least one power source and remote to the identification or decorative shield. As such, the switch may remotely activate the light when the switch is pressed. In one or more embodiments, the switch may be coupled to a rear portion of the identification or decorative shield, or located behind the identification or decorative shield, and the switch may activate the light when a front portion of the identification or decorative shield is pressed, and that in turn presses the switch.

Embodiments of the invention may include a microcontroller coupled with the power source. In one or more embodiments, the microcontroller may cycle through a plurality of power levels to provide multiple light levels from the at least one light when the switch coupled with the identification or decorative shield is pressed. In at least one embodiment, the microcontroller may automatically adjust a power setting of the at least one light based on ambient light or after a configurable period of time, and may turn off the at least one light after a configurable timeout period.

One or more embodiments of the invention enable a method of manufacturing the helmet mounted lighting apparatus, such that the method of manufacture includes one or more of coupling the at least one light, such as an LED, to the at least one power source such as at least one battery, coupling the at least one light to the switch, such as switch 155, 603, 1007 or any other type of switch, and to the at least one power source with an electrical connection that does not travel through an outer wall of the helmet 120 to an inner portion of the helmet, and coupling the heat dissipater 1001 to the at least one light. In one or more embodiments, the at least one power source does not protrude in front of a main surface area of the identification or decorative shield. Embodiments of the method of manufacturing invention may include conforming the identification or decorative shield to a shape of the helmet 120, configuring the identification or decorative shield to removably couple with the helmet 120, and placing the at least one light proximal to the identification or decorative shield.

In at least one embodiment, the method of manufacturing may also include configuring the at least one light to focus the at least one light to point forward from the identification or decorative shield, or may be configured to point downward at an adjustable angle, such that the at least one light may illuminate an area forward of the helmet 120. Embodiments of the invention may include configuring the at least one area on the identification or decorative shield to receive identification or decorative additions, and configuring the switch to activate the at least one light when the switch is pressed.

Embodiment of the method of manufacturing may include remotely coupling the switch to the identification or decorative shield and the at least one power source, such that the configuring of the switch may include configuring the switch to remotely activate the at least one light when the switch is pressed. In one or more embodiments, the method of manufacture may include coupling the switch to a rear portion of the identification or decorative shield, and configuring the shield to press the switch and activate the light when a front portion of the identification or decorative shield is pressed. In at least one embodiment, the method of manufacture may include locating the switch behind the identification or decorative shield.

In one or more embodiments of the invention, the method of manufacturing the helmet mounted lighting apparatus may also include coupling the microcontroller to the at least one power source and one or more of configuring the microcontroller to cycle through a plurality of power levels to provide multiple light levels from the at least one light when the switch coupled with the identification or decorative shield is pressed, configuring the microcontroller to automatically adjust a power setting of the at least one light based on ambient light or after a configurable period of time, and configuring the microcontroller to turn off the at least one light after a configurable timeout period.

Figure 11:
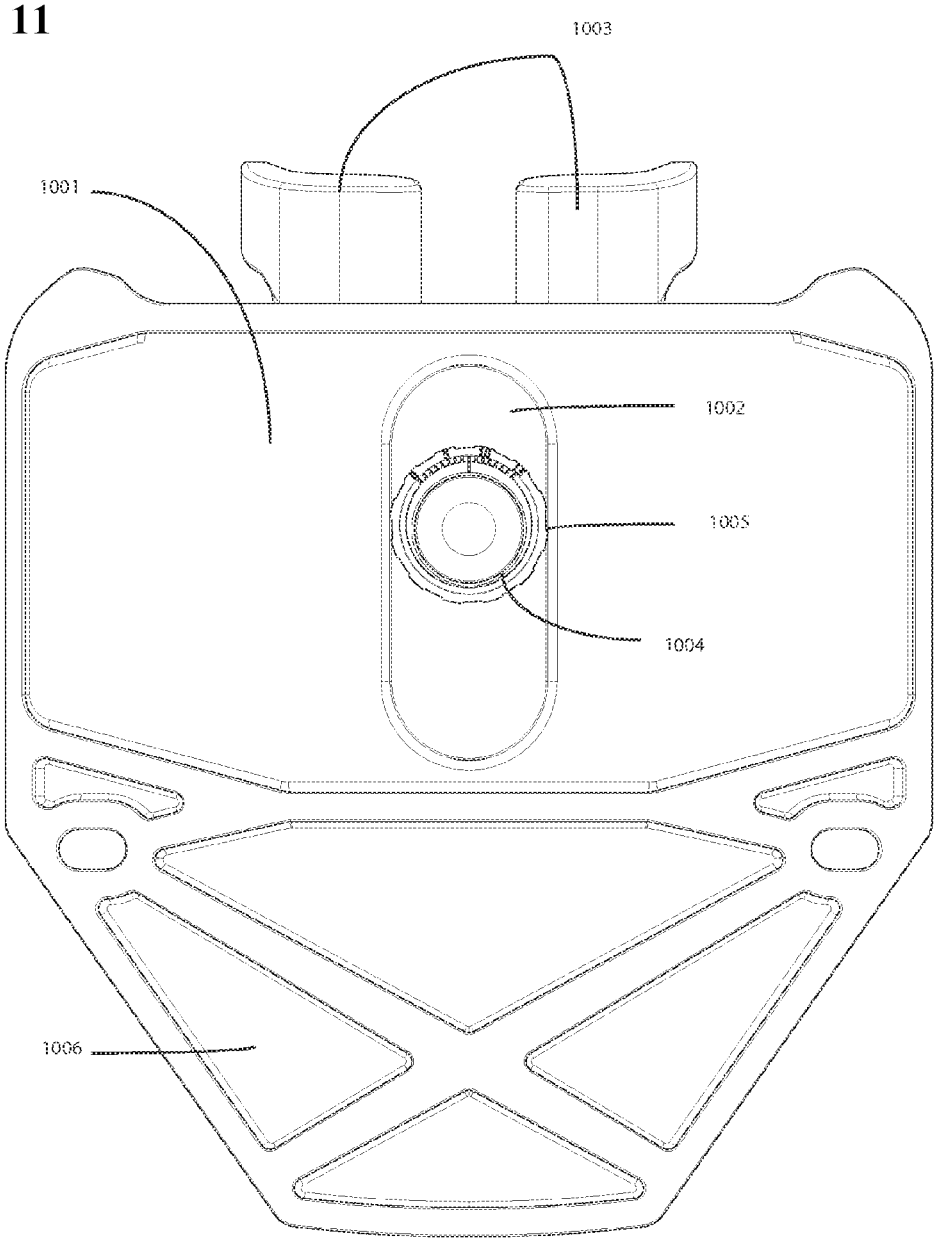
FIG. 11 shows a front view of the helmet mounted lighting apparatus according to one or more embodiments.

FIG. 11 shows a front view of the helmet mounted lighting apparatus according to one or more embodiments. FIG. 11 shows the heat dissipater 1001, the circuit board area 1002, the dual battery housing 1003, the LED lens 1004, the LED housing 1005 and mount housing 1006.

Figure 12:
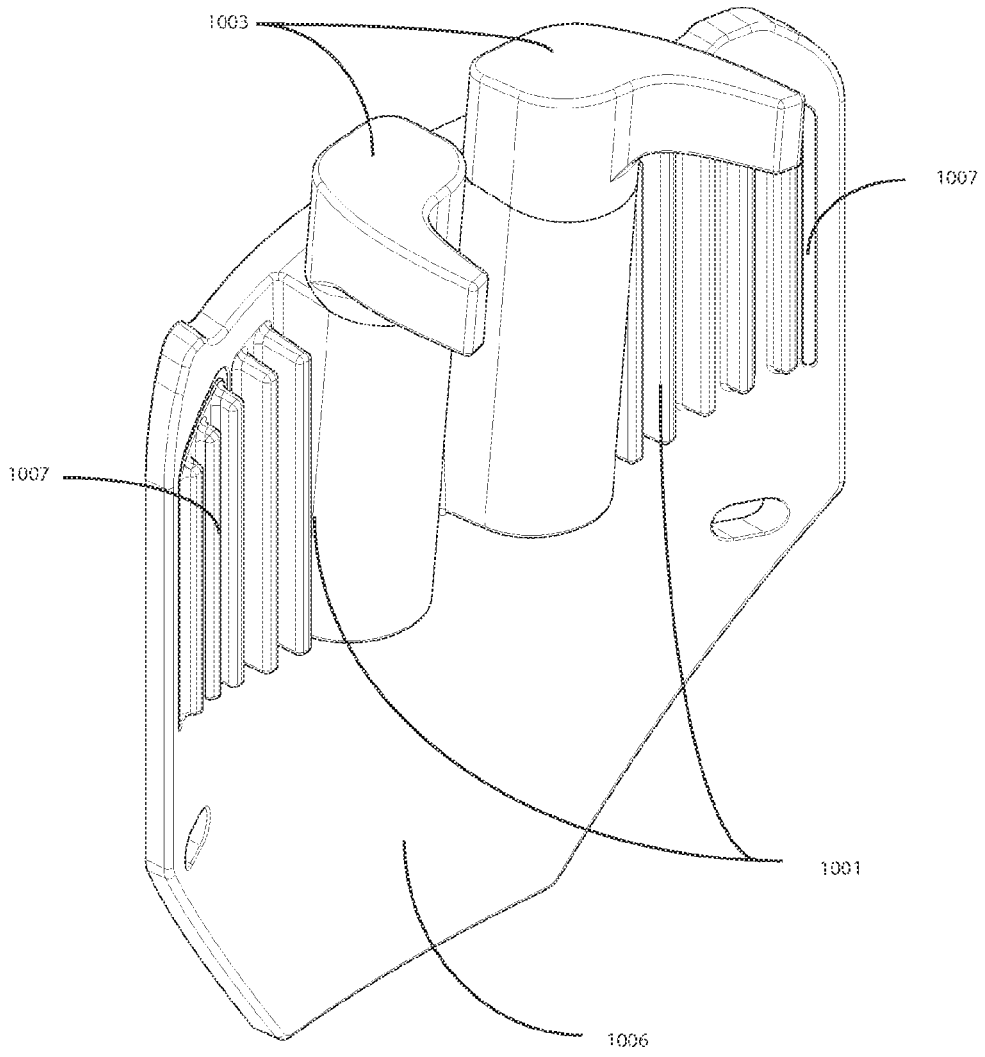
FIG. 12 shows a rear view of the helmet mounted lighting apparatus according to one or more embodiments.

FIG. 12 shows a rear view of the helmet mounted lighting apparatus according to one or more embodiments. FIG. 12 shows the heat dissipater 1001, the dual battery housing 1003, the mount housing 1006 and button overlay 1007 with two power buttons on the left and right sides of the apparatus. As shown in FIG. 12, the heat dissipation fins 1001 do not go all the way to the edge of the apparatus. In one or more embodiments, the button overlay 1007 elements are designed to look like heat fins on either side of the left and right heat dissipater 1001. In one or more embodiments, the button left and right button overlay 1007 are formed from molded rubber and cover a button, such as 603, on either side of the apparatus. As shown, the heat dissipater may include metallic fins such as brass fins on either side of the apparatus while the button overlays may include rubber button covers or any other type of material that may be utilized to depress or assert an underlying button. The fin-like button covers not only carryover the aesthetics of the heat dissipater fins, but also provide a tactile surface for fingers when the user is feeling for a switch. The fin based button overlays are optional and may be replaced by flat surfaces or any other type of material or removed in alternative embodiments to allow direct access to the buttons.

Figure 13:
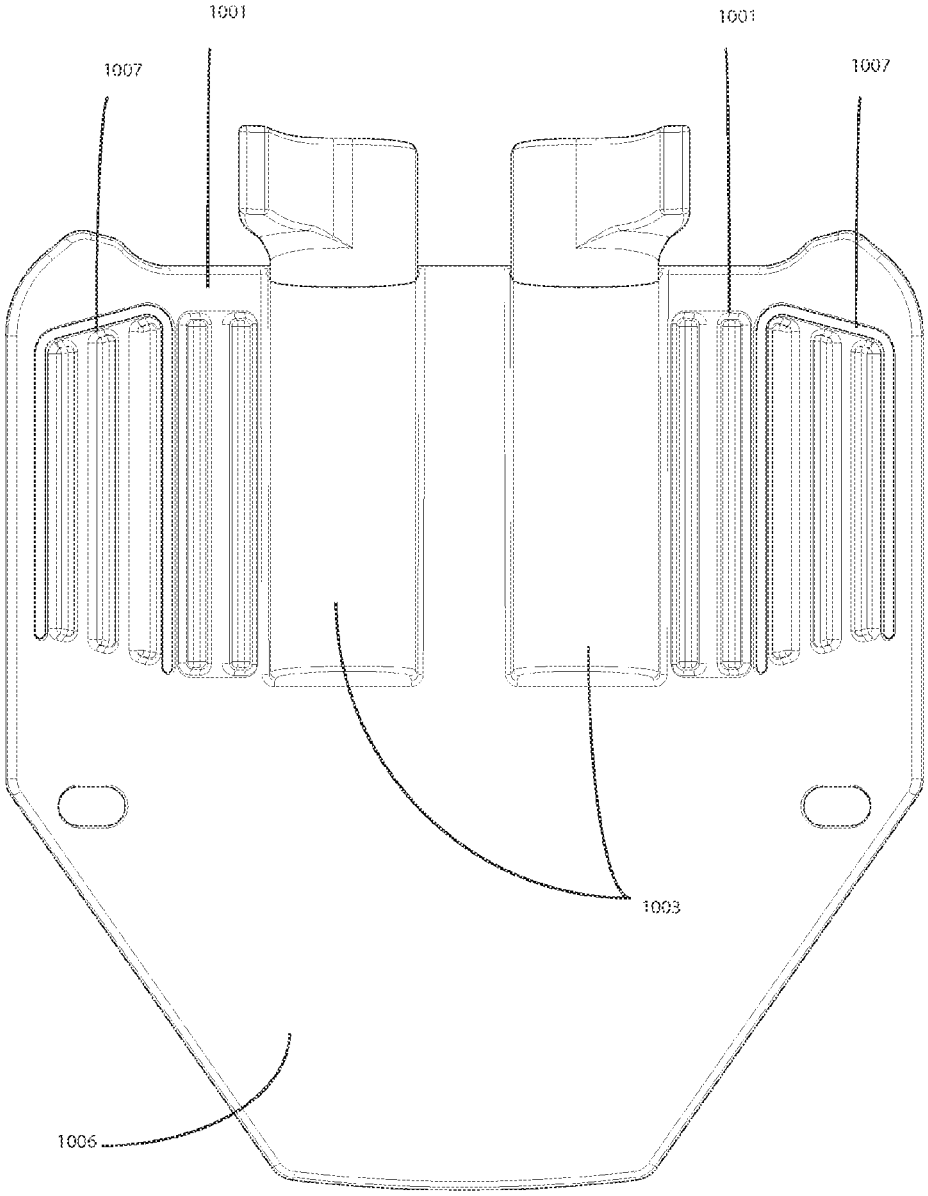
FIG. 13 shows a back view of the helmet mounted lighting apparatus according to one or more embodiments.

FIG. 13 shows a back view of the helmet mounted lighting apparatus according to one or more embodiments, with the heat dissipater 1001, the dual battery housing 1003, the mount housing 1006 and button overlay 1007 with two power buttons on the left and right sides of the apparatus.

Figure 14:
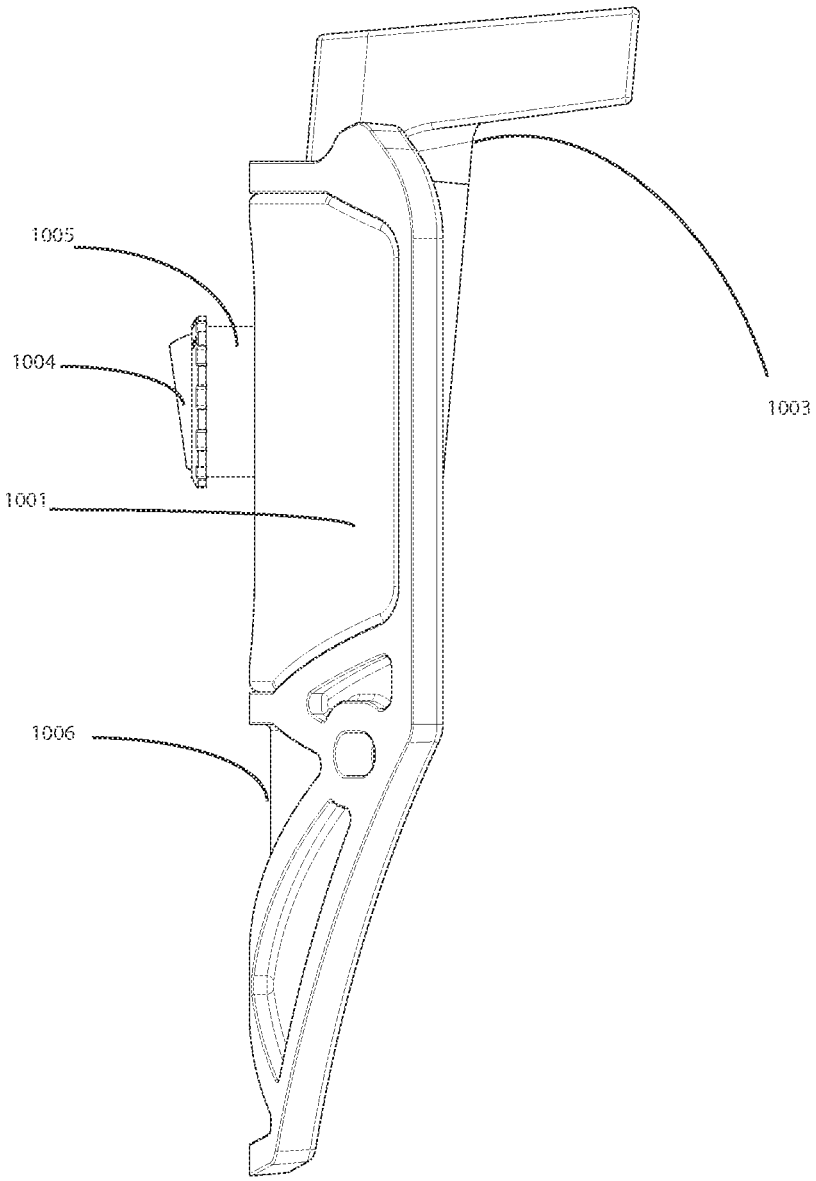
FIG. 14 shows a side view of the helmet mounted lighting apparatus according to one or more embodiments.

FIG. 14 shows a side view of the helmet mounted lighting apparatus according to one or more embodiments, with the heat dissipater 1001, the dual battery housing 1003, the LED lens 1004, the LED housing 1005 and the mount housing 1006.

Figure 15:
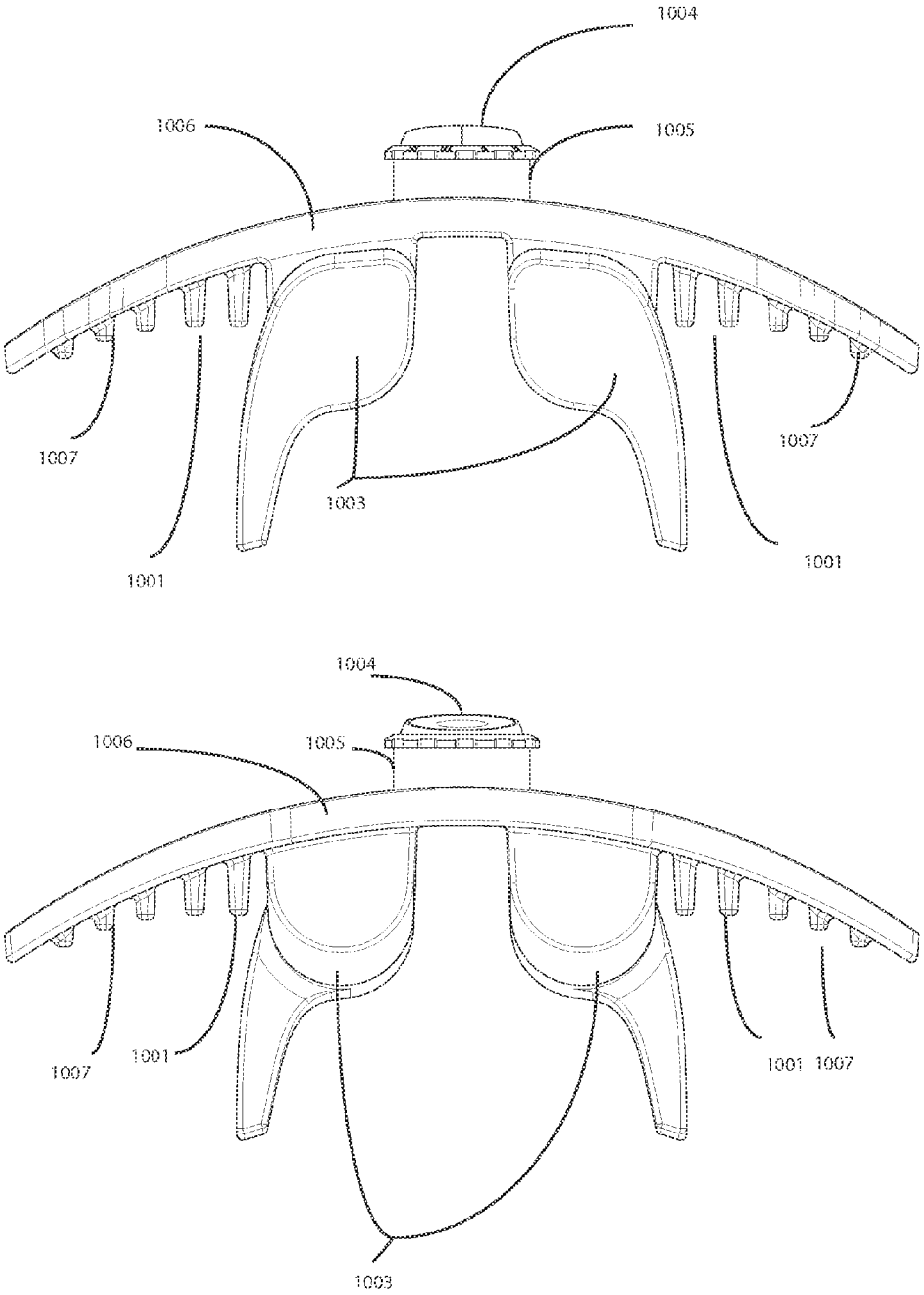
FIG. 15 shows a top view and a bottom view of the helmet mounted lighting apparatus according to one or more embodiments.

FIG. 15 shows a top view and a bottom view of the helmet mounted lighting apparatus according to one or more embodiments, both views showing the heat dissipater 1001, the dual battery housing 1003, the LED lens 1004, the LED housing 1005, the mount housing 1006 and button overlay 1007 with two power buttons on the left and right sides of the apparatus.

While the invention herein disclosed has been described by means of specific embodiments and applications thereof, numerous modifications and variations could be made thereto by those skilled in the art without departing from the scope of the invention set forth in the claims.

What is claimed is:

1. A helmet mounted lighting apparatus comprising:

an identification or decorative shield removably coupled with a helmet, wherein said identification or decorative shield conforms to a shape of said helmet;

at least one light;

at least one power source coupled with said at least one light with an electrical connection that does not travel through an outer wall of said helmet to an inner portion of said helmet and wherein said at least one power source does not protrude in front of a main surface area of said identification or decorative shield;

a switch coupled with said at least one power source and said at least one light;

said at least one light focused to point forward from said identification or decorative shield wherein said at least one light illuminates an area forward of said helmet;

at least one location proximal to said identification or decorative shield to place said at least one light respectively;

at least one area on said identification or decorative shield wherein said at least one area is configured to receive identification or decorative additions; and, said switch activates said at least one light when said switch is pressed.

2. The apparatus of claim 1 wherein said at least one light is configured to point downward at an adjustable angle.

3. The apparatus of claim 1 wherein said switch is remote to said at least one power source and wherein said switch is remote to said identification or decorative shield and wherein said switch is configured to remotely activate said at least one light when said switch is pressed.

4. The apparatus of claim 1 wherein said switch is coupled to a rear portion of said identification or decorative shield and wherein said switch is configured to activate said at least one light when a front portion of said identification or decorative shield is pressed that in turn presses said switch.

5. The apparatus of claim 1 wherein said switch is located behind said identification or decorative shield.

6. The apparatus of claim 1 further comprising:

a microcontroller coupled with said at least one power source.

7. The apparatus of claim 1 further comprising:

a microcontroller coupled with said at least one power source wherein said microcontroller is configured to cycle through a plurality of power levels to provide multiple light levels from said at least one light when said switch coupled with said identification or decorative shield is pressed.

8. The apparatus of claim 1 further comprising:

a microcontroller coupled with said at least one power source wherein said microcontroller is configured to automatically adjust a power setting of said at least one light based on ambient light or after a configurable period of time.

9. The apparatus of claim 1 further comprising:

a microcontroller coupled with said at least one power source wherein said microcontroller is configured to turn off said at least one light after a configurable timeout period.

10. The apparatus of claim 1 further comprising:

a heat dissipater coupled with said at least one light.

11. A method of manufacturing a helmet mounted lighting apparatus comprising:

coupling at least one light to at least one power source;

conforming an identification or decorative shield to a shape of a helmet;

coupling said at least one light to a switch and to said at least one power source with an electrical connection that does not travel through an outer wall of said helmet to an inner portion of said helmet and wherein said at least one power source does not protrude in front of a main surface area of said identification or decorative shield;

configuring said identification or decorative shield to removably couple with said helmet;

placing said at least one light proximal to said identification or decorative shield;

configuring said at least one light to focus said at least one light to point forward from said identification or decorative shield so that said at least one light illuminates an area forward of said helmet;

configuring at least one area on said identification or decorative shield to receive identification or decorative additions;

configuring said switch to activate said at least one light when said switch is pressed.

12. The method of claim 11 further comprising:

configuring said at least one light to point downward at an adjustable angle.

13. The method of claim 11 further comprising:

remotely coupling said switch to said identification or decorative shield and said at least one power source and wherein said configuring said switch comprises configuring said switch to remotely activate said at least one light when said switch is pressed.

14. The method of claim 11 further comprising:

coupling said switch to a rear portion of said identification or decorative shield;

configuring said shield to press said switch and activate said at least one light when a front portion of said identification or decorative shield is pressed.

15. The method of claim 11 further comprising:

locating said switch behind said identification or decorative shield.

16. The method of claim 11 further comprising:

coupling a microcontroller to said at least one power source.

17. The method of claim 11 further comprising:

coupling a microcontroller to said at least one power source;

configuring said microcontroller to cycle through a plurality of power levels to provide multiple light levels from said at least one light when said switch coupled with said identification or decorative shield is pressed.

18. The method of claim 11 further comprising:

coupling a microcontroller to said at least one power source;

configuring said microcontroller to automatically adjust a power setting of said at least one light based on ambient light or after a configurable period of time.

19. The method of claim 11 further comprising:

coupling a microcontroller to said at least one power source;

configuring said microcontroller to turn off said at least one light after a configurable timeout period.

20. The method of claim 11 further comprising:

coupling a heat dissipater to said at least one light.

* * * * *